US005788771A

United States Patent [19]

Madrzak et al.

[11] Patent Number: 5,788,771

[45] Date of Patent: Aug. 4, 1998

[54] APPARATUS FOR APPLYING A FLUID OR PASTRY MEDIUM TO A CONTINUOUS MATERIAL WEB, PARTICULARLY ONE MADE OF PAPER OR CARDBOARD

[75] Inventors: Zygmunt Madrzak; Benjamin Méndez, both of Heidenheim, Germany

[73] Assignee: Voith Sulzer Papiermaschinen GmbH, Heidenheim, Germany

[21] Appl. No.: 702,242

[22] Filed: Aug. 27, 1996

[30] Foreign Application Priority Data

Sep. 1, 1995 [DE] Germany ..... 195 32 388.2

[51] Int. Cl.[6] ..... B05C 1/06

[52] U.S. Cl. ..... 118/261; 118/414

[58] Field of Search ..... 15/256.53, 256.52, 15/256.51; 118/413, 419, 123, 126, 117, 118, 119, 261, 414; 101/465

[56] References Cited

U.S. PATENT DOCUMENTS

| | | | |
|---|---|---|---|
| 3,084,663 | 4/1963 | Warner | 118/118 |
| 3,179,083 | 4/1965 | Warner | 15/256.52 |
| 4,263,870 | 4/1981 | Saito et al. | 118/414 |
| 4,869,933 | 9/1989 | Sollinger et al. | 118/410 |
| 5,156,682 | 10/1992 | Zimmer | 118/119 |
| 5,397,601 | 3/1995 | Korhoner | 118/410 |
| 5,536,312 | 7/1996 | Madrzak et al. | 118/118 |

FOREIGN PATENT DOCUMENTS

| | | |
|---|---|---|
| 0 319 503 | 2/1988 | European Pat. Off. . |
| 84 00 325 | 7/1985 | Germany . |
| WO 87/00091 | 7/1985 | WIPO . |
| WO 91/12373 | 2/1990 | WIPO . |
| WO 95/00256 | 6/1993 | WIPO . |

OTHER PUBLICATIONS

College Physics, Third Edition (1972) Harcourt, Brace, Jovanovich, Inc New York, NY pp. 195–199.

*Primary Examiner*—Brenda A. Lamb

*Attorney, Agent, or Firm*—Taylor & Associates, P.C.

[57] ABSTRACT

The invention relates to an apparatus for applying a fluid or pasty medium to a continuous material web, particularly one made of paper or cardboard, having at least one application unit (1) for the fluid or pasty medium, comprising a roll (2) assigned to the application unit (1) for receiving the fluid or pasty medium in the case of an indirect application or for supplying the web in the event of a direct application, further comprising an application blade (6), and a cleaning blade (7) arranged against the direction of rotation (P) of the roll (2) at a distance from the application blade (6), the cleaning blade (7) limiting by means of the application blade (6) an application chamber (5) for the fluid or pasty medium and having a blade element (12) extending across the width of the web and arranged within a blade base (13). The blade element (12) is movably arranged in a direction running essentially parallel to its longitudinal extension.

22 Claims, 6 Drawing Sheets

APPARATUS FOR APPLYING A FLUID OR PASTRY MEDIUM TO A CONTINUOUS MATERIAL WEB, PARTICULARLY ONE MADE OF PAPER OR CARDBOARD

BACKGROUND OF THE INVENTION

1. Field of the Invention

The present invention relates to an apparatus for applying a fluid or pasty medium to a continuous material web, particularly one made of paper or cardboard.

2. Description of the Related Art

A fluid or pasty medium in the form of color, impregnating fluid, starch or the like may be applied to a continuous material web. The web may consist of paper or cardboard or a textile material. The application of the fluid or pasty medium to the continuous web may take place directly or indirectly. In the case of direct application, the web, making contact with the surface of the roll, is guided past the application unit, and within the area of the application chamber, the fluid or pasty medium is directly applied via the application blade to the web in the form of a coating film. The roll therefore acts as a counter-roll to the application unit. In the case of indirect application, on the other hand, the fluid or pasty medium is first applied to the roll surface and then accepted by the web which makes contact with the roll as it passes by.

As concerns optimum quality, both for direct and indirect application, it is necessary for an absolutely even coating film to be produced on the web. In practice, however, the absolutely even formation of the coating film is prevented if web constituents, such as fibers and foreign bodies or impurities accumulate between the application blade and roll surface or web surface. In such instances, so-called blade stripes are produced on the web which inevitably result in a reduction in quality.

So as to clean the roll surface or material surface to be coated of such fibers, foreign bodies, impurities and such particles, the provision of a so-called cleaning blade against the direction of rotation at a distance from the application blade has already been proposed. By using the cleaning blade, these particles are intended to be scraped off and blade stripes prevented during the application of the fluid or pasty medium.

Such an apparatus with an upstream cleaning blade is already known for example from EP 0 319 503. A blade knife is used as a cleaning blade in this known apparatus. In direct proximity to its effective surface or edge, this blade knife is also provided with openings or ducts, by means of which fluid or pasty medium flows out of the application chamber. The arrangement of the openings or ducts within the blade knife is determined such that the emergent fluid or pasty flow of medium encounters the roll or web surface and rinses the scraped particles. A pre-wetting, which improves the quality of the subsequent application, is also effected during rinsing.

Practice shows that a relatively good rinsing and pre-wetting effect can be achieved with such apparatus. In certain conditions, however, particles do still accumulate in front of the blade knife; in unfavorable conditions, these particles may mix with the thickened residual film and air pockets and may build up in this form on the blade knife. In such instances, both the blade knife and the roll are not only subject to uneven wear, but they also produce considerable disruptions to the coating film. The scraped off particles building up on the blade knife may also be entrained with the roll for a time and be drawn under the application blade bar, which results in even greater disruptions to the film.

To remedy these disadvantages, an apparatus was developed which uses a rotary blade bar on the cleaning blade instead of a blade knife. It has been shown that fibers, foreign body particles or the like accumulate on a blade bar to a less significant extent than on a blade knife and that the rinsing and pre-wetting effect achieved by the blade bar is not worse than when a blade knife is used. Larger accumulations of fibers, foreign body particles or the like do not build up on this blade bar, since surprisingly, they are continuously removed with the rotary movement of the blade bar.

In the case of the above-mentioned apparatus provided with openings or ducts, by means of which the fluid or pasty medium emerges from the application chamber essentially against the roll's direction of rotation and encounters the surface area of the roll or web adjoining the cleaning blade at least partially beyond the application chamber, thereby achieving a rinsing and pre-wetting effect, it has however been shown that particularly at higher pressures within the application chamber, there arises a substantial pressure loss, which has to be compensated once more by an increased output and hence an undesirably high power consumption of the pressure generating device in use. To enhance the effectiveness and economy of the apparatus in question here, it is, however, necessary to operate at ever greater pressures and peripheral speeds of the rolls.

An increased number of undesirable impurities or particles, such as fibers, filler particles, grains of sand or the like, which are separated from the web, therefore occurs in certain types of paper, such as low-quality waste paper. Yet these impurities are supposed to be kept away from the very application blade in order to ensure that the quality of the applied coat is unimpaired.

SUMMARY OF THE INVENTION

An object of the present invention is therefore to extend an apparatus of the initially described type in such a manner that the cleaning effect is further improved, particularly when the pressure inside the application chamber increases, and so that stripe formation caused by impurities is effectively avoided on the web.

This object is solved by an apparatus according to the invention for applying a fluid or pasty medium to a continuous web, particularly one made of paper or cardboard. The blade element is movably arranged in a direction running essentially parallel to its longitudinal extension.

The apparatus according to the invention allows a considerably improved cleaning effect compared to conventional apparatus or methods to be accomplished in a simple and effective manner; this is also particularly the case when the pressure within the application chamber of the apparatus is increased. Moreover, on the basis of the special embodiment of the cleaning blade of the apparatus, only comparatively low losses of output or power are incurred during the circulation of the fluid or pasty medium so as to self-clean the cleaning blade and to achieve the above-identified rinsing and pre-wetting effect over a surface region of the application roll adjoining the cleaning blade against the application roll's direction of rotation, which in turn favors the use of high pressures in the application chamber and a higher throughput of fluid or pasty medium. The use of the apparatus according to the invention therefore results in a higher-quality final product, while simultaneously ensuring enhanced economy.

It has also been shown to be advantageous for the apparatus according to the invention to include at least one movement device for moving the blade element in the direction running essentially parallel to its longitudinal extension. In this manner, impurities can be removed from the roll surface or from the web in an essentially continuous manner, and in fact can be done so immediately in front of the metering element, such as the blade bar. It is self-evident that the blade element's movement can be performed manually, mechanically or in an automated fashion.

To this extent, it has proved to be particularly advantageous to design the movement device for the blade element's continuous, discontinuous, periodic, oscillating and/or gradual movement in that direction running essentially parallel to the blade element's longitudinal extension. The blade element can also be periodically moved one section further respectively. Based on these various types of movement in the named direction, the blade element's cleaning effect can be increased and adapted to different conditions of the web and of the fluid or pasty medium.

According to the invention, there is also provision for the blade element to be arranged in a manner secured against rotation around its longitudinal axis or on the other hand for it to be arranged rotatably around this axis. If the blade element's arrangement is secured against rotation, the blade element's moveable arrangement in a direction running essentially parallel to its longitudinal extension is particularly simple and effective to perform, without the need for intricate design measures. Depending on the design of the invention's apparatus and depending on the various properties of the webs and the fluid or pasty medium, a blade element rotatably arranged around its longitudinal axis, has, however, also led to positive results.

In a preferred embodiment, the blade element has an essentially circular cross section. This cross-sectional shape makes it possible to produce the blade element according to the invention in a particularly economical fashion and to arrange the blade element within the apparatus in a simple manner in terms of design.

The blade element is advantageously designed to be rope-like or band-like. In this manner, the blade element has both flexible and high-tensile properties so that it can be easily handled, easily combined with a suitable movement device and can be stored or disposed of to save space.

In this connection, it has also proved particularly advantageous for the rope-like or band-like blade element to have a twisted or plaited structure. As a result, the blade element can be simply and effectively produced by means of methods known from ropemaking, such as twining, twirling and stranding or entwining, and various materials used for the blade element can be combined by means of this structure and its associated production method to form a blade element with specific desirable properties. A band-like blade element can also be produced by several adjacent rope-like sections which are joined, e.g., by sewing them together to form a flat rope.

Another advantageous embodiment feature provides that the blade element has a projection extending in the blade element's longitudinal direction on at least one of its two end-face ends. This projection may be a limit fixture which allows the blade element to be connected to a suitable movement device, or on the other hand it may be a projection of the blade element itself. As a result of the latter measure, the blade element can be wound for example on to a suitable apparatus or stowed on the apparatus according to the invention. It is also possible for any potential material wear to be replaced by this projection in that, e.g., the blade element is moved along by the movement device and a new blade element section is made available.

It has been shown to be particularly advantageous for the blade element's free ends extending in the longitudinal direction to be joined together to form a continuous loop. In this manner, the blade element can be moved like an endless belt, etc., in a particularly simple and effective fashion, and a continuous removal of impurities can be achieved while ensuring a high cleaning effect of the roll surface or web. The movement devices used in conjunction with an endless blade element can also be very simply and inexpensively designed.

Another embodiment feature according to the invention provides that the apparatus comprises at least one coil device on to which at least one section of the blade element can be wound. As already mentioned in conjunction with the blade element's projection, such a coil device is particularly suitable for a blade element that has two free ends and can therefore be easily wound on to the coil device or can be moved by a driven coil means in a desired manner.

In conjunction with such a coil device and a simple blade element or one formed as an endless loop, it has also been shown to be advantageous for the apparatus to include at least one deflection device for the blade element. If the deflection device is, e.g., a driven deflection device, the blade element's arrangement, guidance and drive can therefore be easily implemented.

The blade element is preferably made at least in part from an elastic material with a modulus of elasticity of $\leqq 40{,}000$ $N/mm^2$. In accordance with the invention, there is also provision for the elastic material to be a spongy material. Such materials are particularly soft and flexible and therefore do not lead to any impairment of the web used. These materials can moreover be easily compressed and have a large inner surface, which not only makes it possible to pick up fibers, filler particles, grains of sand or other particles particularly well but also allows these impurities to be effectively removed by washing. The blade element according to the invention is therefore also perfectly suited to tricky material webs such as waste paper.

To ensure that the blade element has adequate stability and tensile strength, it is advantageous for the elastic material to be connected to an essentially inelastic support material. This support material ensures a reliable transfer of the forces applied by the movement device to the blade element so as to move this element and prevents the elastic material from being worn to excess. The connection of the elastic material to the inelastic support material, and vice versa, may take place by twisting, stranding or entwining the two materials or in any other suitable manner, such as by adhesion or by creating a composite-type end product.

A particularly advantageous embodiment feature of the invention provides that the blade base of the cleaning blade is subdivided into several sections spaced apart by at least one gap across the length of the blade base, whereby the at least one gap forms an overflow opening for the fluid or pasty medium. The blade base sections need not necessarily have a uniform length. The gaps acting as overflow openings may also vary in size. Due to the fluid or pasty medium overflowing, the blade element on which impurities have built up is washed out. While the blade element moves through the blade base, any long fibers or coarse impurity particles adhering to the blade element are, in particular, scraped off at the gaps of the blade base and rinsed away by the fluid or pasty medium passing through the blade base gaps. Excellent cleaning results can be obtained in this manner. Since the overflow openings formed by the gaps of the individual blade base sections are located in the immediate vicinity of the web or application roll, the amount of fluid or pasty medium used for cleaning can be drastically reduced and in consequence, the means of conveyance needed for circulation can also be diminished and a considerable energy saving achieved. A general rinsing and prewetting effect of the material web can likewise be achieved using this embodiment of the blade base.

As another positive embodiment, there is provision for the blade element's blade base to have at least one fluid chamber into which the blade element protrudes at least in part. In order to build up a pressure within the fluid chamber, at least one pressure generating device corresponding to the fluid chamber, such as a pressure pump or the like, is also provided according to the invention. Whenever pressure is applied to the fluid chamber, the blade element is therefore always pressed against the application roll or the web, which—particularly when the blade element is worn—has the advantage of not producing any inaccurate fits in relation to the application roll or web and hence impairments of the cleaning quality.

The apparatus according to the invention preferably further comprises at least one cleaning device for the blade element. This cleaning device may be a container filled with a detergent, a spray device which sprays a detergent on to the blade element, or the like. In addition to the blade element's self-cleaning effect resulting from the aforementioned special embodiment of the blade base with its several sections, it is therefore possible to achieve a further enhancement of the blade element's cleaning effect and hence a high-quality web surface.

Another feature of the invention provides that the cleaning blade is designed as an overflow weir which forms a gap in relation to the application roll, with the result that the fluid or pasty medium can pass through between the cleaning blade and the roll. In accordance with the invention, the size of this gap, i.e., the distance of the blade-element side facing the roll in relation to the surface of the roll, is adjustable within a range of 0 to 1 mm; this measurement indication refers to conventional dimensions of apparatus according to the class and can of course be varied depending on the particular application. Thanks to this feature, the blade element is not only able to achieve an effective cleaning effect in an advantageous manner, but at the same time the overflow of fluid or pasty medium can also be controlled beneficially.

Finally, as a further feature, there is provision for the cleaning blade's blade base, which is supported by an elastic mount, to be impermeable to the fluid or pasty medium. Together with the invention's embodiment of the blade base with its spaced apart sections, an undesirable pressure loss within the application chamber is therefore avoided, helping to reduce the amount of fluid or pasty medium circulated for cleaning purposes and to minimize the circulation devices needed for this purpose.

BRIEF DESCRIPTION OF THE DRAWINGS

Exemplary embodiments of the invention with further embodiments and advantages will be described and explained in more detail with reference to the attached drawings as follows.

DETAILED DESCRIPTION OF THE INVENTION

Figure 1:
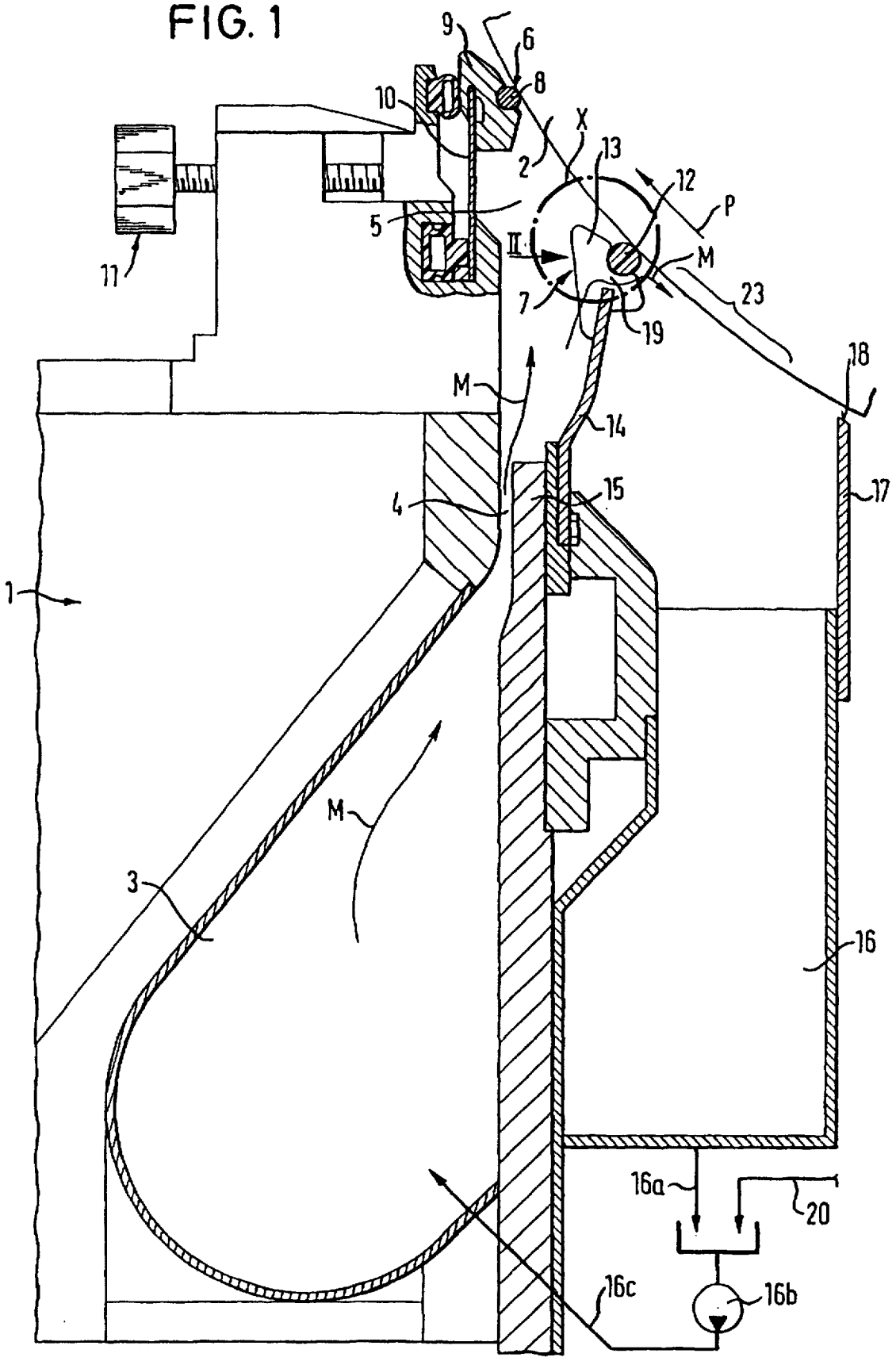
FIG. 1 is a schematic sectional view of a first exemplary embodiment of the invention based on an "STDA application unit"

In the exemplary embodiment shown in FIG. 1, which relates to an apparatus for indirectly applying fluid or pasty medium, application unit 1 is arranged approximately in the eight o'clock position of an application roll 2 which rotates in the direction of arrow P.

A material web, such as a paper web, though not shown in the drawings for the sake of greater clarity, runs in the usual manner on application roll 2.

Application unit 1 has a color distribution duct 3 by means of which a fluid or pasty medium M is supplied from the side via a color distribution pipe (not shown). The fluid or pasty medium M leaves color distribution pipe 3, reaching via a nozzle 4 an application chamber 5 which is essentially limited by an application blade 6 and a cleaning blade 7. Application blade 6 is of a conventional design and has a blade bar 8 supported within a blade base 9 which is secured in a conventional manner to a strip 10 and the position of which is adjustable vis-à-vis application roll 2 via a known adjustment means 11. These described elements are known and therefore do not need to be described in further detail.

According to the invention, cleaning blade 7 arranged against the direction of rotation P of application roll 2 at a distance from application blade 6 comprises a blade element 12 which is supported within a blade base 13. Blade base 13 is in turn secured to the upper free end of an elastic retaining frame 14. Blade base 13 and retaining frame 14 together form the mount of cleaning blade 7. The other free end of retaining frame 14 is fixed to a nozzle flap 15 which is arranged in a known manner to be foldable toward the roll center for cleaning purposes and is arranged to be adjustable so as to adjust nozzle 4.

Retaining frame 14 of cleaning blade 7 is completely enclosed so that the fluid or pasty medium M from application chamber 5 is unable to pass through retaining frame 14. In this manner, it is ensured that no pressure losses arise at this site, which is relatively far away from the contact surface of cleaning blade 7 with application roll 2 and which does not offer an optimum self-cleaning effect of cleaning blade 7 as a result of rinsing by means of the fluid or pasty medium M.

The application unit also has a return groove 16 on that side of nozzle flap 15 opposite color distribution pipe 3; on its upper side, this return groove supports in a known manner a so-called air boundary layer scraper 17 which with its edge 18, reaches up close to the surface of application roll 2. Outlet **16*a* of return groove 16 is connected to a pressure generating means, i.e., a booster pump 16b, into which a supply line 20 for fresh fluid or pasty medium M also merges. Outlet 16c of booster pump 16b is in turn connected to color distribution pipe 3**.

Together with the fluid or pasty medium supplied via supply line 20, the fluid or pasty medium M scraped off from the surface of application roll 2 by blade element 12 of cleaning blade 7 is therefore treated and reused in a cyclical manner.

Figure 2:
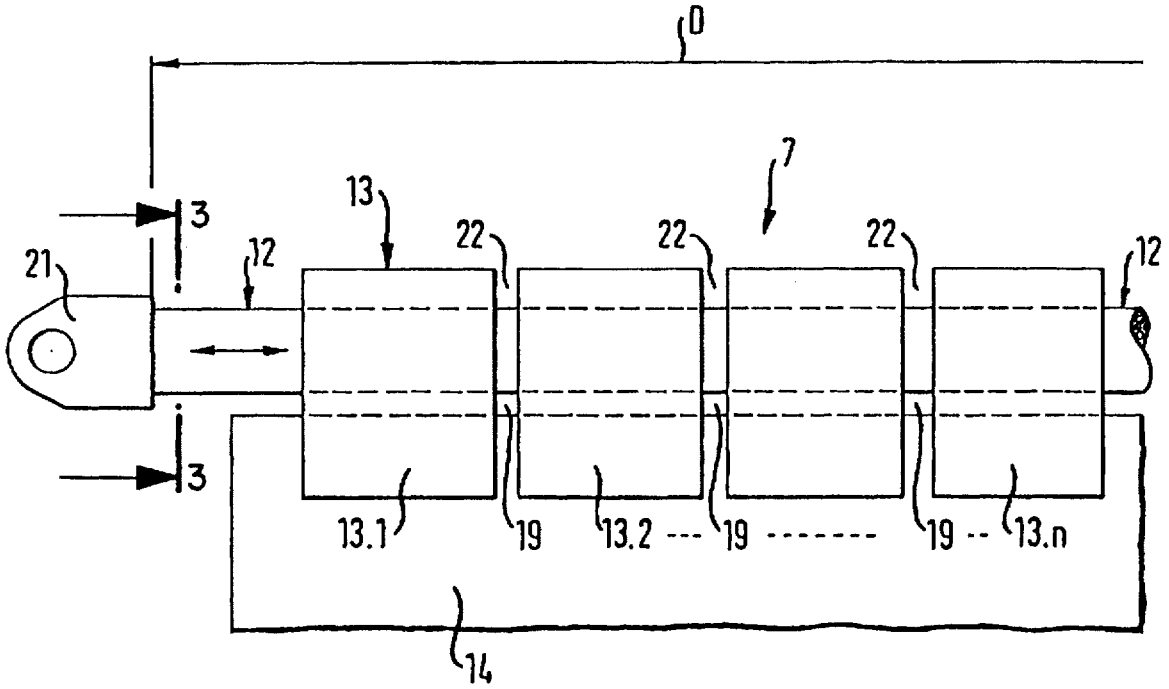
FIG. 2 is a schematic frontal view of the apparatus according to the invention in the area of the cleaning blade, as viewed from arrow II in FIG. 1.

As viewed from arrow II in FIG. 1, FIG. 2 shows a schematic frontal view of an embodiment of the apparatus according to the invention in the area of cleaning blade 7.

As indicated by the double arrow in FIG. 2, the rope-like or band-like blade element 12 in a direction running essentially parallel to its longitudinal extension D is movably arranged within blade base 13. Blade element 12 is also positioned in a manner secured against rotation around its longitudinal axis; a rotation of blade element 12, as known to be the case for conventional cleaning blades, is therefore not possible here. According to the invention, however, a rotatable arrangement of blade element 12 around its longitudinal axis is provided for certain applications. The two free ends of blade element 12 are fitted with limit fixtures 21 which are used for connection to a movement means, not shown in FIG. 2, which moves blade element 12 in the above direction in an oscillating manner.

As can also be easily discerned in FIG. 2, blade base 13 of cleaning blade 7 is subdivided across its length into several sections 13.1 to 13.n spaced apart by at least one gap 22. In the present instance, the length of the individual sections 13.1 to 13.n is about 10 and 50 mm in order to obtain as large a number of gaps 22 as possible. The sections of blade base 13 need not necessarily have a uniform length. Depending on requirements, blade base 13 may also have sections with differing lengths. Gaps 22 of blade base 13, i.e., to be more precise in this instance: gaps 22, blade element 12 and the upper side of retaining frame 14 together form openings 19 through which the fluid or pasty medium can overflow from application chamber 5 to return groove 16 and can wash out blade element 12 on which impurities have built up. Part of the fluid or pasty medium flowing out via openings 19 also encounters surface area 23 of application roll 2 adjoining cleaning blade 7 beyond application chamber 5, thus achieving the known rinsing and pre-wetting effect.

The flow cross section of an individual gap 22 between two adjacent sections of blade base 13 is about 10 to 50 $mm^2$. The named values may however vary, depending on the respective application. These dimensions ensure that on the one hand, the flow of fluid or pasty medium through gaps 22 is in fact sufficiently intense to clean blade element 12 and to pre-wet application roll 2, while on the other hand, the pressure loss that arises and the flow quantity are sufficiently limited so as to minimize the overall fluid quantity within the circulation cycle and hence to keep the necessary power consumption of circulation or booster pump 16b to a minimum. An unnecessary pressure loss is avoided by the fact that as a result of the invention's embodiment of cleaning blade 7, the overflow first takes place at the outlet of application chamber 5 and at an area advantageous for cleaning, rinsing and pre-wetting. The quantities of fluid or pasty medium required for these latter purposes are therefore comparatively low. The throughput of booster pump 16b or the pressure inside application chamber 5 can therefore be increased while maintaining the same pumping capacity.

In conjunction with the embodiment according to FIG. 2, it should also be emphasized that in particular, the combination of the invention's corresponding movement of the cleaning blade with the apparatus according to FIG. 2 leads to very advantageous cleaning results, since for example, long fibers or coarse impurity particles adhering to blade element 12 are scraped off when blade element 12 is moved through blade base 13 at gaps 22 of blade base 13 and are rinsed away by the fluid or pasty medium passing through gaps 22 or openings 19 of blade base 13. Blade base 13 is substantially impermeable to the mediums.

Figure 3:
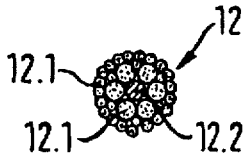
FIG. 3 is a schematic sectional view along line 3—3 in FIG. 2.

FIG. 3 shows a schematic sectional representation of blade element 12 along the line 3—3 in FIG. 2, with the blade element's rope-like twisted structure being particularly easy to identify. Blade element 12 is essentially made from a spongy, elastic material 12.1 with a modulus of elasticity of less than or equal to 40.000 $N/mm^2$. This material 12.1 can be easily compressed and has a high inner surface which ensures that not only fibers, filler particles, grains of sand or other particles are picked up particularly well but that these impurities are also equally effectively removed by washing. Blade element 12 according to the invention is therefore also perfectly suitable for problematic webs, such as waste paper. To ensure that blade element 12 has sufficient stability and tensile strength, which are necessary for performing the blade element's movement according to the invention, spongy elastic material 12.1 is preferably connected in a suitable manner to an essentially inelastic support material 12.2. The connection may take place by twisting, stranding or entwining the two materials 12.1, 12.2 or in any other suitable manner, such as by adhesion or by creating a composite-type material of 12.1 and 12.2. In the present instance, support material 12.2 also forms the core of the rope-type blade element.

It can also be inferred from FIG. 3 that blade element 12 has an essentially circular cross section. The cross section may also, however, be slightly oval or polygonal in design so as to avoid a rotation or torsion of blade element 12 as a result of the effect of force of the fluid or pasty medium or of application roll 2.

Figure 4:
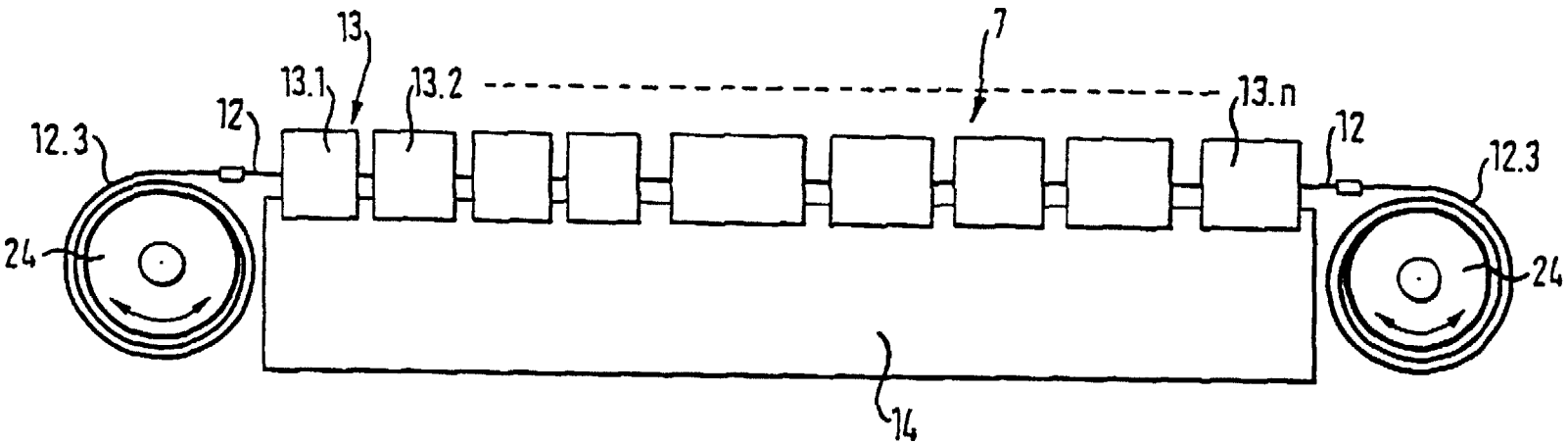
FIG. 4 is a schematic frontal view as in FIG. 2, but more detailed.

As viewed from arrow II in FIG. 1, FIG. 4 shows a schematic frontal view of the apparatus according to the invention in the area of cleaning blade 7 with further details. The basic structure of cleaning blade 7 essentially corresponds to the structure as was described in conjunction with FIGS. 2 and 3. In addition, the end-face free ends of rope-type blade element 12 are, however, provided with projections 12.3 extending in the blade element's longitudinal direction; the end sections of these projections are wound on two driven coils 24, each arranged to the side of blade base 13. The driven coils 24 act as movement means for moving blade element 12. The mobility of coils 24 is indicated in the drawing by double arrows. An oscillating movement or a gradual further movement of blade element 12 in a direction running essentially parallel to its longitudinal extension D is preferably achieved by this version.

Figure 5:
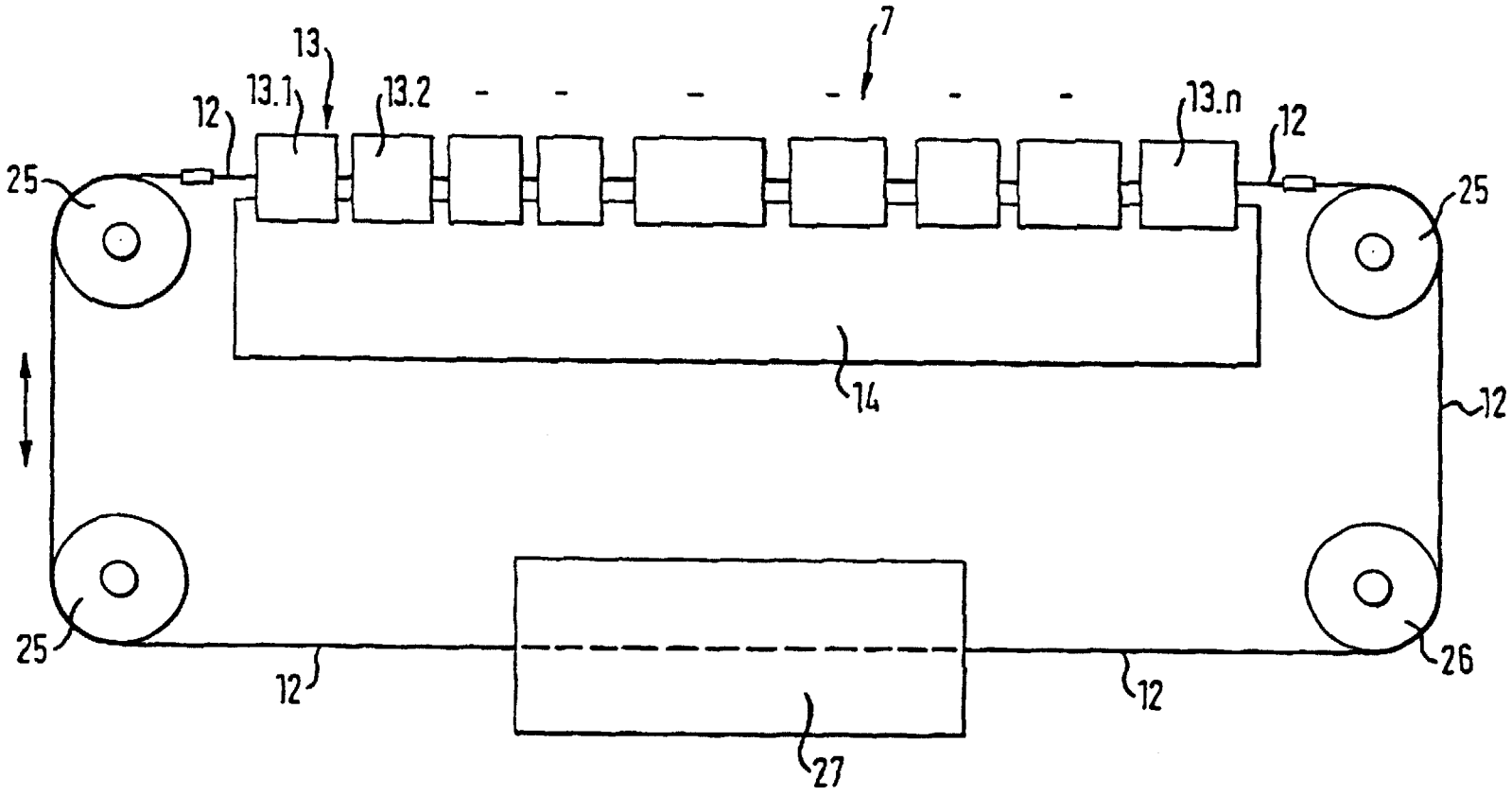
FIG. 5 is a schematic frontal view of a second embodiment of an apparatus according to the invention in the area of the cleaning blade with further details, as viewed from arrow II in FIG. 1.

Analogous to the representation in FIG. 4, FIG. 5 shows a schematic frontal view of a second embodiment of the apparatus according to the invention in the area of cleaning blade 7 with further details. The basic structure of cleaning blade 7 in turn essentially corresponds to that according to FIGS. 2 and 3. The special feature of this version is that the blade element's free ends are joined together to form an endless loop which runs over several deflection or support rollers 25, 26, with one of the rollers simultaneously acting as a drive roller 26. This arrangement is particularly suitable for a continuous or periodic movement of blade element 12 in a direction running essentially parallel to longitudinal extension D of blade element 12. In the case of a periodic movement, drive roller 26 is designed in the present instance such that blade element 12 is respectively moved one section further through blade base 13. The mobility of endless blade element 12 is indicated in the drawing by a double arrow.

According to FIG. 5, the apparatus according to the invention also includes a cleaning device 27 for blade element 12. Cleaning device 27 is arranged in the embodiment according to FIG. 5 at a lower section of blade element 12 formed as an endless loop. In terms of its movement, blade element 12 is therefore simultaneously guided and cleaned by cleaning device 27. Cleaning device 27 can be designed as a container filled with detergent or as a container through which a detergent flows or as a spray means that sprays the detergent on to moving blade element 12, or the like.

The various solutions according to FIGS. 4 and 5 result in an excellent cleaning effect, since due to the movement of blade element 12 according to the invention, a different blade element section always comes into contact with the material web passing over application roll 2, thus ensuring a continuous removal of impurities and creating the possibility of additionally cleaning blade element 12.

Figure 6:
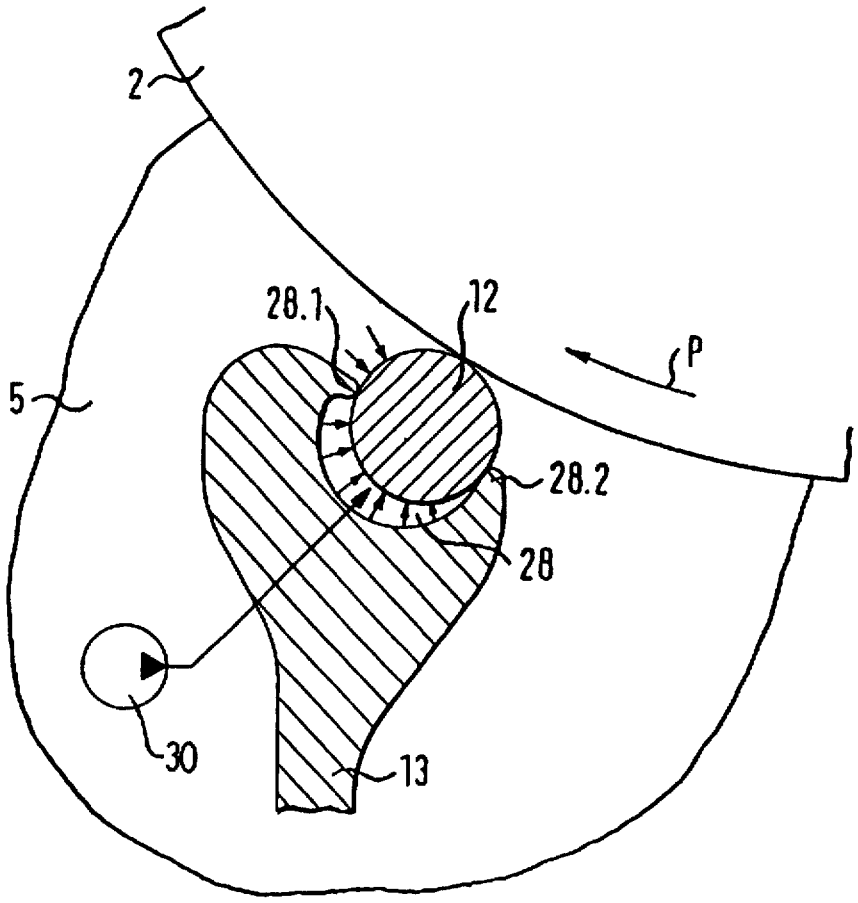
FIG. 6 is an enlarged representation of area X in FIG. 1.

FIG. 6 shows an enlarged representation of area X in FIG. 1, illustrating another detailed version of blade base 13. As can be identified in the drawing, blade base 13 has on its side facing application roll 2, a groove-like fluid chamber 28 into which rope-like blade element 12 partially projects. Two lugs 28.1 and 28.2 of fluid chamber 28 grip behind the maximum diameter of blade element 12, so that this element cannot be unintentionally displaced or cannot be pressed out of fluid chamber 28 too much. To generate a hydrostatic pressure within fluid chamber 28, at least one suitable pressure generating means 30 corresponding to fluid chamber 28 of blade base 13 is provided in the apparatus according to the invention. In order to avoid excessive pressure losses within fluid chamber 28, a blade base 13, which is not divided into a plurality of sections or which is merely fitted with comparatively small through-openings for the fluid or pasty medium, should preferably be used in this embodiment.

The advantage of the embodiment features according to FIG. 6 lies primarily in the fact that even when blade element 12 becomes worn, the application of pressure to fluid chamber 28 of blade base 13 means that the blade element is always pressed securely against application roll 2 in a manner that ensures an accurate fit.

Figure 7:
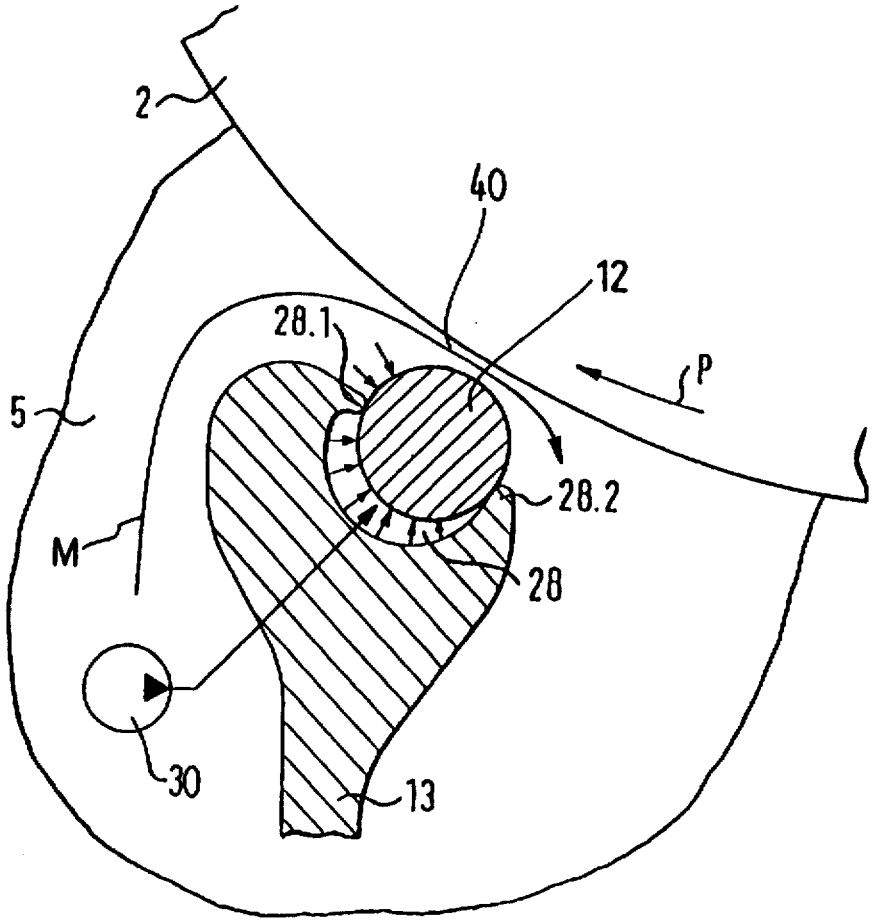
FIG. 7 is an enlarged representation, similar to FIG. 6, of a third embodiment of an apparatus according to the invention.

According to a further embodiment (FIG. 7), there is provision not to subdivide blade base 13 of blade element 12 into sections 13.1 and 13.n described above, but to design it as an enclosed overflow weir, whereby blade element 12 just about makes contact with the roll and a partial quantity of the fluid or pasty medium can flow over via a small gap 40 of about 0 to 1 mm between blade element 12 and application roll 2 toward return groove 16. This gap, i.e., the distance of the side of blade element 12 that points toward application roll 2 in relation to the surface of roll 2, is preferably adjustable. These embodiment features make it possible in an advantageous manner both for blade element 12 to achieve an effective cleaning effect and, at the same time, for the overflow of fluid or pasty medium to be controlled.

The aforementioned embodiments of the apparatus according to the invention and the method according to the invention merely represent examples. In particular, the dimensions named in conjunction with the apparatus may vary considerably, depending on the application. Instead of the above movement means for moving blade element 12 in the manner stipulated by the invention, any other suitable means are likewise conceivable, for instance those which achieve the desired movement via a lever mechanism, cam, hydraulically, pneumatically, via an electric motor, such as a stepper motor, or the like. A combination of oscillating, gradual or periodic or other movements of blade element 12 is also possible in a direction running essentially parallel to longitudinal extension D of blade element 12.

If blade element 12 has a band-like design, this blade element band may also be produced by combining several rope-like blade element members placed side by side and which have a round, quadratic or rectangular cross section, etc. The complete blade element may also have cross-sectional shapes other than those designated as part of the specification.

It is likewise feasible, in accordance with the invention, to provide the blade element with further profiles which correspond to certain drive or movement mechanisms of the apparatus, such as an additional profile resembling a tooth or a V-belt and engaging with a suitable gear wheel or a V-belt pulley or the like. This profile should preferably be located at a blade-element side which does not touch the material web or the roll.

Reference symbols in the claims, specification and the drawings merely help to make the invention more easily comprehensible and are not intended to limit the scope of protection.

What is claimed is:

1. An apparatus for applying a fluid or pasty medium to a continuous material web having a width, comprising:

at least one application unit for the medium; and a roll associated with one of said application units, said roll having a longitudinal axis and a direction of rotation, said roll configured for at least one of guiding the web to which the medium is directly applied, and receiving and indirectly applying the medium to the web; wherein said application unit is comprised of:

a first blade base;

an application element supported within said first blade base;

a second blade base; and a cleaning element oriented in a direction transverse to said direction of rotation of said roll, said cleaning element being disposed at a distance upstream from said application element relative to said direction of rotation of said roll, said cleaning element and said application element at least partly defining and limiting an application chamber for the medium, said cleaning element having a blade element carried by said second blade base, said blade element having a longitudinal direction and extending across the width of the web, said blade element being movable in at least one direction substantially parallel to said longitudinal axis of said roll wherein said second blade base includes at least one fluid chamber, and wherein said blade element extends at least in part into said fluid chamber.

2. The apparatus of claim 1, further comprising at least one means for moving said blade element in said at least one substantially parallel direction.

3. The apparatus of claim 2, wherein said moving means moves said blade element in at least one of a continuous and discontinuous manner.

4. The apparatus of claim 2, wherein said moving means moves said blade element in at least one of a periodic, oscillating and linear moving manner.

5. The apparatus of claim 1, wherein said blade element has a longitudinal axis, and wherein said blade element is one of rotatable and non-rotatable around said longitudinal axis.

6. The apparatus of claim 1, wherein said blade element has a substantially circular cross-section.

7. The apparatus of claim 1, wherein said blade element has an elongate configuration.

8. The apparatus of claim 7, wherein said blade element includes an elastic material one of twisted, stranded and entwined with a substantially inelastic material.

9. The apparatus of claim 1, wherein said blade element has opposing end-face ends, and wherein said blade element has a projection extending from at least one of said end-face ends, said projection connected to means for moving said blade element in said at least one direction.

10. The apparatus of claim 9, further comprising at least one cleaning means for cleaning said blade element, said cleaning means being associated with said projection.

11. The apparatus of claim 1, further comprising at least one deflection means for moving said blade element in said at least one direction.

12. The apparatus of claim 1, wherein said blade element is comprised of an elastic material.

13. The apparatus of claim 12, wherein said elastic material comprises a compressible material.

14. The apparatus of claim 12, wherein said blade element includes a substantially inelastic support material connected to said elastic material.

15. The apparatus of claim 1, further comprising an elastic mount supporting said second blade base, and wherein said second blade base is substantially impermeable to the medium.

16. An apparatus for applying a fluid or pasty medium to a continuous material web having a width, comprising:

at least one application unit for the medium; and a roll associated with one of said application units and having a direction of rotation, said roll configured for at least one of guiding the web to which the medium is directly applied, and receiving and indirectly applying the medium to the web; wherein said application unit is comprised of:

an application element;

a blade base;

a cleaning element oriented in a direction transverse to said direction of rotation of said roll, said cleaning element being disposed at a distance from said application blade, said cleaning element and said application element at least partly defining and limiting an application chamber for the medium, said cleaning element having a blade element carried by said blade base, said blade element having a longitudinal direction and extending across the width of the web, said blade element being movable in a direction substantially parallel to said longitudinal direction; wherein said blade element has opposing end-face ends, and wherein said blade element has a projection extending from at least one of said end-face ends, said blade element and said projection defining an endless loop, said projection connected to means for moving said blade element in said at least one direction.

17. An apparatus for applying a fluid or pasty medium to a continuous material web having a width, comprising:

at least one application unit for the medium; and a roll associated with one of said application units and having a direction of rotation, said roll configured for at least one of guiding the web to which the medium is directly applied, and receiving and indirectly applying the medium to the web; wherein said application unit is comprised of:

an application element;

a blade base; and a cleaning element oriented in a direction transverse to said direction of rotation of said roll, said cleaning element being disposed at a distance from said application blade, said cleaning element and said application element at least partly defining and limiting an application chamber for the medium, said cleaning element having a blade element carried by said blade base, said blade element having a longitudinal direction and extending across the width of the web, said blade element being movable in a direction substantially parallel to said longitudinal direction, said blade element having opposing end-face ends and a projection extending from at least one of said end-face ends, said projection connected to means for moving said blade element in said at least one direction, wherein said said means for moving said blade element is comprised of;

at least one coiling means for coiling at least one section of said blade element thereon.

18. An apparatus for applying a fluid or pasty medium to a continuous material web having a width, comprising:

at least one application unit for the medium; and a roll associated with one of said application units and having a direction of rotation, said roll configured for at least one of guiding the web to which the medium is directly applied, and receiving and indirectly applying the medium to the web; wherein said application unit is comprised of:

an application element;

a blade base having a length, said blade base comprising a plurality of sections across said length spaced apart by at least one gap, said at least one gap defining an overflow opening for the medium; and a cleaning element oriented in a direction transverse to said direction of rotation of said roll, said cleaning element being disposed at a distance from said application blade, said cleaning element and said application element at least partly defining and limiting an application chamber for the medium, said cleaning element having a blade element carried by said blade base, said blade element having a longitudinal direction and extending across the width of the web, said blade element being movable in a direction substantially parallel to said longitudinal direction.

19. The apparatus of claim 18, wherein said blade base includes at least one fluid chamber, and wherein said blade element extends at least in part into said fluid chamber.

20. The apparatus of claim 19, further comprising at least one pressure generating means associated with said fluid chamber.

21. An apparatus for applying a fluid or pasty medium to a continuous material web having a width, comprising:

at least one application unit for the medium; and a roll associated with one of said application units, said roll having a longitudinal axis and a direction of rotation, said roll configured for at least one of guiding the web to which the medium is directly applied, and receiving and indirectly applying the medium to the web; wherein said application unit is comprised of:

an application element;

a blade base; and an overflow weir oriented in a direction transverse to said direction of rotation of said roll, said overflow weir being disposed at a distance from said application blade, said overflow weir and said application at least partly defining and limiting an application chamber for the medium, said overflow weir having a blade element carried by said blade base, said blade element having a longitudinal direction and extending across the width of the web, said blade element being movable in at least one direction substantially parallel to said longitudinal axis of rotation, said overflow weir defining a gap with respect to said roll, whereby the medium may flow between said overflow weir and said roll.

22. The apparatus of claim 21, wherein said overflow weir is disposed a distance away from said roll, said distance of said weir from said roll being greater than 0 mm and less than 1 mm.

* * * * *

UNITED STATES PATENT AND TRADEMARK OFFICE

CERTIFICATE OF CORRECTION

PATENT NO. : 5,788,771

DATED : August 4, 1998

INVENTOR(S) : Madrzak, et al.

It is certified that error appears in the above-identified patent and that said Letters Patent is hereby corrected as shown below:

Title Page, Item [54]

Line 2, delete "PASTRY", and substitute -- PASTY -- therefor.

Column 1

Line 2, delete "PASTRY", and substitute -- PASTY -- therefor.

Column 13

Line 5, after "application", insert -- element -- therefor.

Signed and Sealed this

Twenty-second Day of June, 1999

*Attest:*

Q. TODD DICKINSON

*Attesting Officer*

*Acting Commissioner of Patents and Trademarks*